United States Patent [19]

Bordages

[11] Patent Number: 4,499,799

[45] Date of Patent: Feb. 19, 1985

[54] INTERNAL GRIPPING PIPE WRENCH

[75] Inventor: John W. Bordages, Lakeshore, Miss.

[73] Assignee: Texaco Inc., White Plains, N.Y.

[21] Appl. No.: 555,233

[22] Filed: Nov. 25, 1983

[51] Int. Cl.[3] ..... B25B 15/00

[52] U.S. Cl. ..... 81/446; 81/443

[58] Field of Search ..... 81/446, 443

[56] References Cited

U.S. PATENT DOCUMENTS 2,482,501 9/1949 Oravetz ..... 81/446

2,528,873 11/1950 Dorman ..... 81/446

*Primary Examiner*—Frederick R. Schmidt

*Assistant Examiner*—J. T. Zatarga

*Attorney, Agent, or Firm*—Robert A. Kulason; Henry C. Dearborn

[57] ABSTRACT

A tool for insertion into a pipe in order to apply torque by contact with the inside surface of the pipe. It has an axially located socket in a central rotor with a concentric ring around the rotor. The ring has a plurality of toothed gripping arms pivoted on the ring and connected to the rotor by links pivoted at both ends so that relative rotation of the rotor extends the gripping arms for contacting the inside of the pipe by the teeth.

2 Claims, 4 Drawing Figures

INTERNAL GRIPPING PIPE WRENCH

BRIEF SUMMARY OF THE INVENTION

Briefly this invention concerns a tool for use in applying torque to pipes or the like from the inside surface thereof. In particular, it deals with an internal gripping pipe wrench.

An internal a pipe wrench has been proposed and described in a U.S. Pat. No. 3,471,160, A. P. Sabo, Oct. 7, 1969. However, that wrench structure provides a tapered element that is inserted from an end of a pipe. The tapered element has a maximum diameter greater than the inside diameter of the pipe being torqued. Furthermore, that wrench structure makes use of an internally threaded sleeve which must surround the tapered element in order to apply the necessary gripping force on the inside edge of the pipe.

On the other hand, this invention provides a tool which may be inserted into the end of a pipe to apply torque. It grips the inside surface of the pipe at practically any desired distance therein which can be substantially beyond the outer edges of the pipe. Thus, it is an object of this invention to provide a tool in the nature of a pipe wrench which is useful for gripping and applying torque to pipe on the inside surface thereof. Consequently, it may be used in situations where access to the exterior of the pipe is completely restricted.

Briefly, the invention concerns an inside gripping pipe wrench which comprises a round unit adapted for insertion in a pipe to apply torque thereto by contact with its inside surface. The said unit comprises a rotor having a socket therein, and gripping means radially extensible from said unit. It also comprises means for extending said gripping means into contact with said inside surface upon rotation of said rotor.

Again briefly, the invention concerns an inside gripping pipe wrench which comprises a flat, cylindrical unit adapted for insertion into a pipe to apply torque thereto by contact with its inside surface. The said unit is symmetrical whereby it can torque said pipe either way depending upon which face is inserted first. Said unit comprises a rotor having an axially concentric flat sided socket extending there through, and concentric annular means surrounding said rotor. It also comprises a plurality of toothed gripping means spaced circumferentially about said annular means. Each said gripping means comprises an arcuate arm pivotally mounted on said annular means and having teeth at the free end relative to said annular means. It also comprises a plurality of links for interconnecting said free ends of said arcuate arms with said rotor, and means for mounting said links pivotally at both ends. The said links are longer than the radial distance from said rotor to said annular means whereby relative rotation of said rotor inside said annular means will extend said gripping means to make said contact with the pipe.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

In oil well and many other operations where threaded pipes are employed, there is often a situation where the exterior surroundings of the pipe so limits the space that application of torque to the pipe is extremely difficult. However, the problem may be overcome by using a tool according to this invention. The tool may be inserted freely from an end of the pipe, and then torque may be applied to the inside surface for rotating it as desired. The tool has a socket with detent so that it may be attached to the end of a torque bar or rod (not shown) and inserted for use. By reason of the symmetrical construction of the tool it may be inserted in the pipe with either side (or face) of the tool first depending upon which direction the torque is to be applied.

Figure 1:
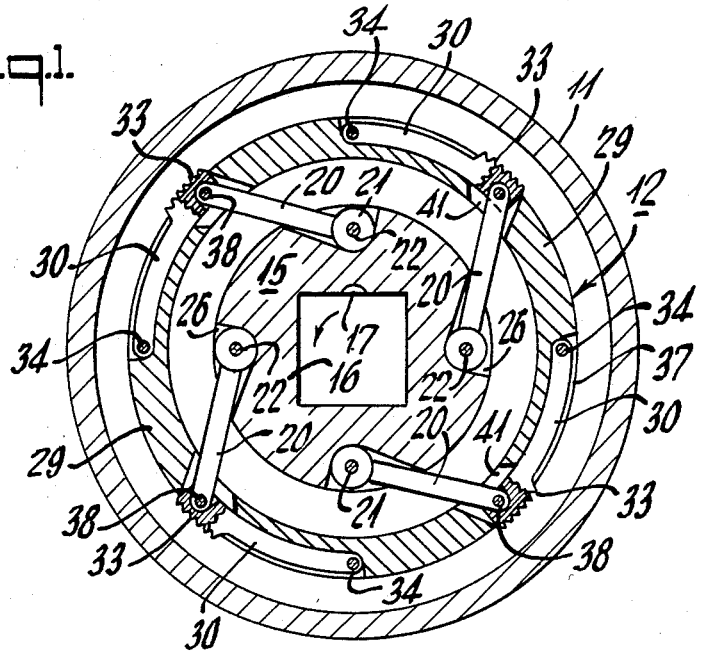
FIG. 1 is a cross-sectional view showing the tool located inside a pipe to be torqued thereby.

With reference to the drawings it will be observed that FIG. 1 shows a cross section of a pipe 11 with a tool 12 inside thereof. The tool 12 has a central rotor 15 with an axially located socket 16. Socket 16 extends axially all the way through the rotor 15. There is a spherical indentation 17 which is centrally located on one of the flat sides of the socket 16. Indentation 17 is intended for use in cooperation with a detent (not shown) on a torque rod or the like (not shown) which would be inserted in the socket 16 as the tool 12 is inserted and applied to the pipe 11. It will be understood that while the socket 16 preferably has a square cross sectional configuration as illustrated in the drawings, it might take other flat sided geometric shapes if desired.

The rotor 15 has four pivotally mounted links 20. Each link 20 has a hub 21 at one end with a hole 25 to accommodate a pin 22 that extends axially through the rotor 15. The hole 25 extends through the hub 21 so that the pin 22 may pass through the hole 25 and permit free rotation or pivotal action by the link 20 about the pin 22.

The rotor 15 has four circumferentially spaced recesses 26 which are for receiving the hubs 21 of the links 20. These recesses are shaped to provide for the amount of limited rotation of the links 20 that is required. The movement will be described hereafter.

Figure 2:
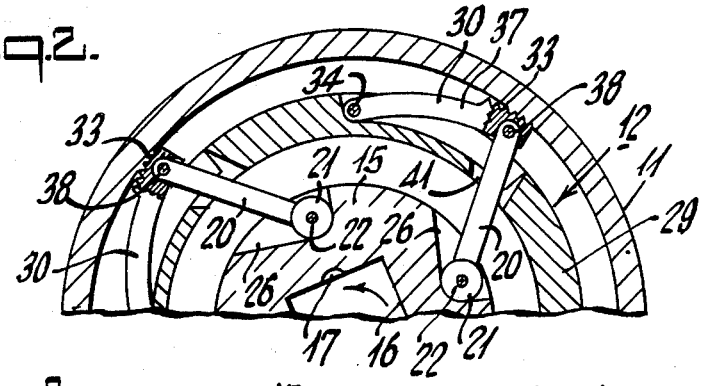
FIG. 2 is a partial cross-sectional view like FIG. 1 but showing the tool with the rotor moved relative to the surrounding ring of the tool so as to extend the gripping teeth into contact with the inside surface of the pipe.
Figure 3:
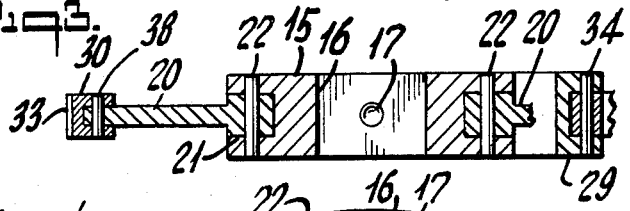
FIG. 3 is a radial partial cross-section showing the rotor with one pivotally connected link in full, including one of the toothed gripping heads.
Figure 4:
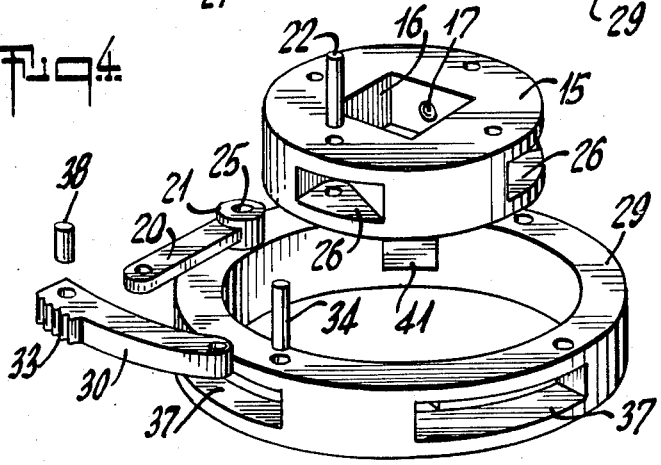
FIG. 4 is an exploded perspective showing one of the gripping arms and one of the links for the entire tool structure.

There is an annular member or ring 29 which surrounds the rotor 15. Ring 29 has four arcuately shaped arms 30 pivotally mounted thereon. Each of the arms 30 has teeth 33 at the free end thereof. These teeth 33 act to grip the inside surface of the pipe 11 as indicated by the FIG. 2 illustration. Each arm 30 is pivotally attached to the ring 29 by a pin 34 that extends through the ring 29. Each arm 30 is designed to fit inside of a circumferentially spaced slot 37 in the outside surface of the ring 29.

The radially outer ends of the links 20 are pivotally attached to the toothed (free) ends of the arms 30 by pins 38. There are openings 41 which extend radially through the ring 29 at the end of the slots 37 that are adjacent to the toothed ends of the arms 30, in order to permit the links 20 to extend through these openings 41.

OPERATION

It may be noted that when the various parts of the tool 12 are in the relative positions which are illustrated in FIG. 1, the tool is fully retracted insofar as the gripping elements (arms 30 and teeth 33) are concerned. This position is that caused by the rotor 15 having been rotated (relative to the ring 29) in a clockwise direction as far as it will go. With the parts in this position the tool 12 is ready to be inserted inside of a pipe, e.g. the pipe 11, on the end of a torque rod (not shown) or other extension device which has a square hub designed to fit into the socket 15.

The hub (not shown) will have a detent on one of its faces for cooperating with the indentation 17 to hold the tool 12 in place on the end of the extension device as it is manipulated into place inside the pipe. Then, after the tool 12 has been inserted inside a pipe 11, the rotor 15 will be rotated counterclockwise relative to the ring 29 and this will cause the links 20 to rotate about their pivot pins 22. That rotation will in turn cause the toothed ends 33 of the arms 30 to be displaced radially outward. In other words, the arms 30 will be extended by making them pivot about their pivot pins 34 until all the teeth 33 contact the inside surface of the pipe 11.

Next, torque may be applied to the pipe 11 by continuing to rotate the rotor 15 via the socket 16. As this rotation force is applied the teeth 33 will be forced into firm gripping contact against the inner surface of the pipe 11. Under those conditions, torque applied to the pipe 11 will be counterclockwise as viewed in FIGS. 1 and 2. In order to release the torque, the rotor will merely be rotated in the opposite direction.

It will be noted that because of the symmetry of the tool, the direction of rotation of torque applied to pipe 11 may be reversed by merely inserting the tool 12 with the opposite side first. Then, clockwise rotation would be applied and the action would be the same as that described above but with the opposite direction of the forces. Thus, the gripping of teeth 33 and the torque applied would be in a clockwise direction instead of counterclockwise as per the illustrated showings in FIGS. 1 and 2 of the drawings.

While a particular embodiment of the invention has been described above in considerable detail in accordance with the applicable statutes, this is not to be taken as in any way limiting the invention but merely as being descriptive thereof.

I claim:

1. Inside gripping pipe wrench, comprising a flat cylindrical unit adapted for insertion into a pipe to apply torque thereto by contact with its inside surface, said unit being symmetrical whereby it can torque said pipe either way depending upon which face is inserted first, said unit comprising a rotor having an axially concentric flat sided socket extending therethrough, concentric annular means surrounding said rotor, a plurality of toothed gripping means spaced circumferentially about said annular means each said gripping mens comprising an arcuate arm pivotally mounted on said annular means and having teeth at the free end relative to said annular means, a plurality of links for interconnecting said free ends of said arcuate arms with said rotor, and means for mounting said links pivotally at both ends, said links being longer than the radial distance from said rotor to said annular means whereby relative rotation of said rotor inside said annular means will extend said gripping means to make said contact with the pipe.

2. Inside gripping pipe wrench according to claim 1, wherein said flat sided socket is square in cross section.

* * * * *